US011009281B1

(12) United States Patent
Kridel et al.

(10) Patent No.: US 11,009,281 B1
(45) Date of Patent: May 18, 2021

(54) ICE MAKING ASSEMBLIES AND REMOVABLE NOZZLES THEREFOR

(71) Applicant: Haier US Appliance Solutions, Inc., Wilmington, DE (US)

(72) Inventors: Stephen Kridel, Wooster, OH (US); Brent Alden Junge, Evansville, IN (US); Justin Tyler Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/929,506

(22) Filed: Jul. 15, 2020

(51) Int. Cl.

| | |
|---|---|
| ***F25C 1/25*** | (2018.01) |
| ***F25C 1/04*** | (2018.01) |
| ***F25C 1/02*** | (2006.01) |
| ***F25D 11/00*** | (2006.01) |
| ***F25D 25/00*** | (2006.01) |
| ***F25D 17/04*** | (2006.01) |
| ***F25D 1/02*** | (2006.01) |

(52) U.S. Cl.
CPC ..... *F25D 11/006* (2013.01); *F25D 1/02* (2013.01); *F25D 17/04* (2013.01); *F25D 25/005* (2013.01); *F25D 2323/122* (2013.01); *F25D 2400/18* (2013.01); *F25D 2600/06* (2013.01)

(58) Field of Classification Search
CPC ..... F25C 1/25; F25C 1/045; B05B 1/02
See application file for complete search history.

(56) References Cited

U.S. PATENT DOCUMENTS

| | | | | |
|---|---|---|---|---|
| 4,006,605 A | | 2/1977 | Dickson et al. | |
| 4,359,874 A | | 11/1982 | McCarty | |
| 4,505,130 A | * | 3/1985 | Hibino | F25C 1/045 62/347 |
| 4,966,015 A | | 10/1990 | Wessa | |
| 4,970,877 A | | 11/1990 | Dimijian | |
| 5,117,645 A | | 6/1992 | Bryant | |
| 5,167,132 A | | 12/1992 | Meier | |

(Continued)

FOREIGN PATENT DOCUMENTS

| | | |
|---|---|---|
| JP | 2003262442 A | 9/2003 |
| JP | 2004132645 A | 4/2004 |

(Continued)

OTHER PUBLICATIONS

Full Cone Spray/Ultra-wide antle TSP series nozzles; H.Ikeuchi & Co., LTD, https://www.kirinoikeuchi.co.jp/eng/products/spray/1ryutai/315; archived Nov. 11, 2017; accessed Nov. 21, 2020 (Year: 2017).*

*Primary Examiner* — Cassey D Bauer
(74) *Attorney, Agent, or Firm* — Dority & Manning, P.A.

(57) ABSTRACT

An ice making assembly, a provided herein, may include a conductive ice mold, a sealed refrigeration system, and a water dispenser. The conductive ice mold may define a mold cavity. The sealed refrigeration system may include an evaporator in thermal communication with the ice mold. The water dispenser may be positioned below the ice mold to direct an ice-building spray of water to the mold cavity. The water dispenser may include a dispenser base and a spray cap selectively secured to the dispenser base. The spray cap may include a nozzle head defining an outlet aperture and an attachment wing extending radially from the nozzle head into the dispenser base.

20 Claims, 10 Drawing Sheets

(56) References Cited

U.S. PATENT DOCUMENTS

| | | | | |
|---|---|---|---|---|
| 5,224,358 | A | 7/1993 | Yamanaka et al. | |
| 6,357,720 | B1 | 3/2002 | Shapiro et al. | |
| 6,453,696 | B1 | 9/2002 | Hayakawa | |
| 6,502,416 | B2 | 1/2003 | Kawasumi et al. | |
| 7,062,936 | B2 | 6/2006 | Rand et al. | |
| 2004/0226311 | A1* | 11/2004 | Ishitomi | F25C 1/045 62/348 |
| 2007/0194153 | A1* | 8/2007 | Frazee | B05B 15/50 239/587.1 |

FOREIGN PATENT DOCUMENTS

| | | | |
|---|---|---|---|
| JP | 2004225924 | A | 8/2004 |
| JP | 2015190707 | A | 11/2015 |
| JP | 6089974 | B2 | 3/2017 |
| JP | 2017141985 | A | 8/2017 |
| KR | 200460218 | Y1 | 5/2012 |
| KR | 101556705 | B1 | 10/2015 |
| MY | 141042 | A | 2/2010 |
| RU | 2586919 | C2 | 6/2016 |
| WO | WO2018041519 | A1 | 3/2018 |

* cited by examiner

ICE MAKING ASSEMBLIES AND REMOVABLE NOZZLES THEREFOR

FIELD OF THE INVENTION

The present subject matter relates generally to ice making appliances, and more particularly to appliances for making substantially clear ice.

BACKGROUND OF THE INVENTION

In domestic and commercial applications, ice is often formed as solid cubes, such as crescent cubes or generally rectangular blocks. The shape of such cubes is often dictated by the environment during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water, and such liquid water can freeze within the plurality of cavities to form solid ice cubes. Typical solid cubes or blocks may be relatively small in order to accommodate a large number of uses, such as temporary cold storage and rapid cooling of liquids in a wide range of sizes.

Although the typical solid cubes or blocks may be useful in a variety of circumstances, there are certain conditions in which distinct or unique ice shapes may be desirable. As an example, it has been found that relatively large ice cubes or spheres (e.g., larger than two inches in diameter) will melt slower than typical ice sizes/shapes. Slow melting of ice may be especially desirable in certain liquors or cocktails. Moreover, such cubes or spheres may provide a unique or upscale impression for the user.

In recent years, various ice presses have come to market. For example, certain presses include metal press elements that define a profile to which a relatively large ice billet may be reshaped (e.g., in response to gravity or generated heat). Such systems reduce some of the dangers and user skill required when reshaping ice by hand. However, the time needed for the systems to melt an ice billet is generally contingent upon the size and shape of the initial ice billet. Moreover, the quality (e.g., clarity) of the final solid cube or block may be dependent on the quality of the initial ice billet.

In typical ice making appliances, such as those for forming large ice billets, impurities and gases may be trapped within the billet. For example, impurities and gases may collect near the outer regions of the ice billet due to their inability to escape and as a result of the freezing liquid to solid phase change of the ice cube surfaces. Separate from or in addition to the trapped impurities and gases, a dull or cloudy finish may form on the exterior surfaces of an ice billet (e.g., during rapid freezing of the ice cube). Generally, a cloudy or opaque ice billet is the resulting product of typical ice making appliances. In order to ensure that a shaped or final ice cube or sphere is substantially clear, many systems form solid ice billets that are substantially bigger (e.g., 50% larger in mass or volume) than a desired final ice cube or sphere. Along with being generally inefficient, this may significantly increase the amount of time and energy required to melt or shape an initial ice billet into a final cube or sphere. Furthermore, freezing such a large ice billet (e.g., larger than two inches in diameter or width) may risk cracking, for instance, if a significant temperature gradient develops across the ice billet.

In the past, attempts have been made to generate clear ice by spraying water to a chilled mold. Unfortunately, though, such systems are only suitable for generating relatively small ice cubes (e.g., less than an inch in width) that are non-spherical and lacking in a solid core. One problem that can arise with generating larger pieces of ice (e.g., ice billets) is an inconsistent spray pattern. Additionally or alternatively, it can be difficult to clean apertures or nozzles from which water is sprayed. Over time, sediment, suspended solids, or Total Dissolved Solids (TDS) may accumulate within a nozzle, which may impede portions of a nozzle or travel with the water spray. This may result in cloudy or misshapen ice (e.g., ice billets).

Accordingly, further improvements in the field of ice making would be desirable. In particular, it may be desirable to provide an appliance or assembly for rapidly and reliably producing substantially clear ice billets while addressing one or more of the above identified issues, such as mitigating sediments build up.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice making assembly is provided. The ice making assembly may include a conductive ice mold, a sealed refrigeration system, and a water dispenser. The conductive ice mold may define a mold cavity. The sealed refrigeration system may include an evaporator in thermal communication with the ice mold. The water dispenser may be positioned below the ice mold to direct an ice-building spray of water to the mold cavity. The water dispenser may include a dispenser base and a spray cap selectively secured to the dispenser base. The spray cap may include a nozzle head defining an outlet aperture and an attachment wing extending radially from the nozzle head into the dispenser base.

In another exemplary aspect of the present disclosure, an ice making assembly is provided. The ice making assembly may include a conductive ice mold, a sealed refrigeration system, and a water dispenser. The conductive ice mold may define a mold cavity. The sealed refrigeration system may include an evaporator in conductive thermal communication with the ice mold. The water dispenser may be positioned below the ice mold to direct an ice-building spray of water to the mold cavity. The water dispenser may include a dispenser base and a spray cap. The dispenser base may define a water path and a receiving slot radially spaced apart from the water path. The spray cap may be selectively secured to the dispenser base downstream from the water path. The spray cap may include a nozzle head defining a plurality of outlet apertures directed towards the mold cavity and an attachment wing extending radially from the nozzle into the receiving slot.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
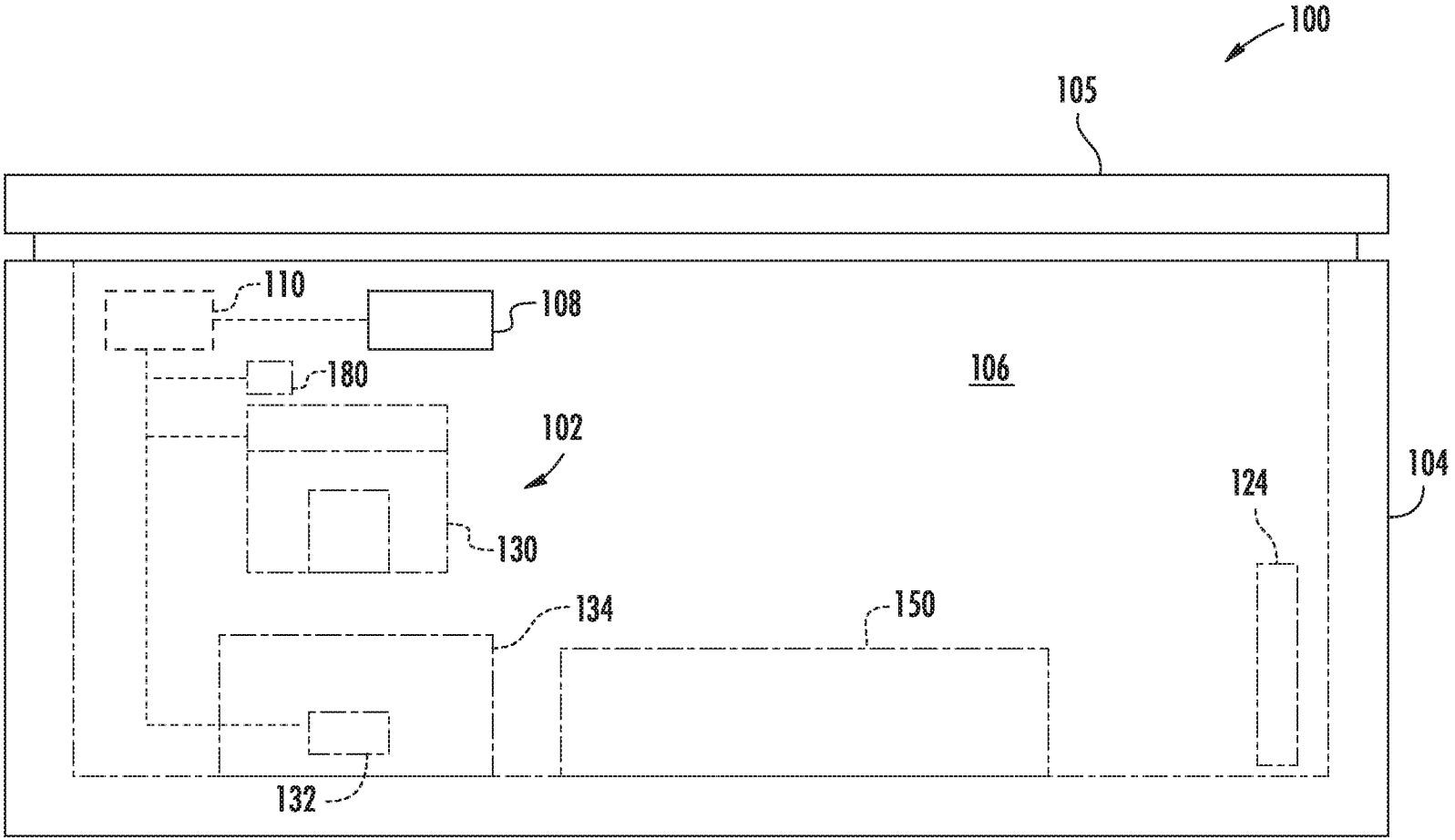
FIG. 1 provides a side plan view of an ice making appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
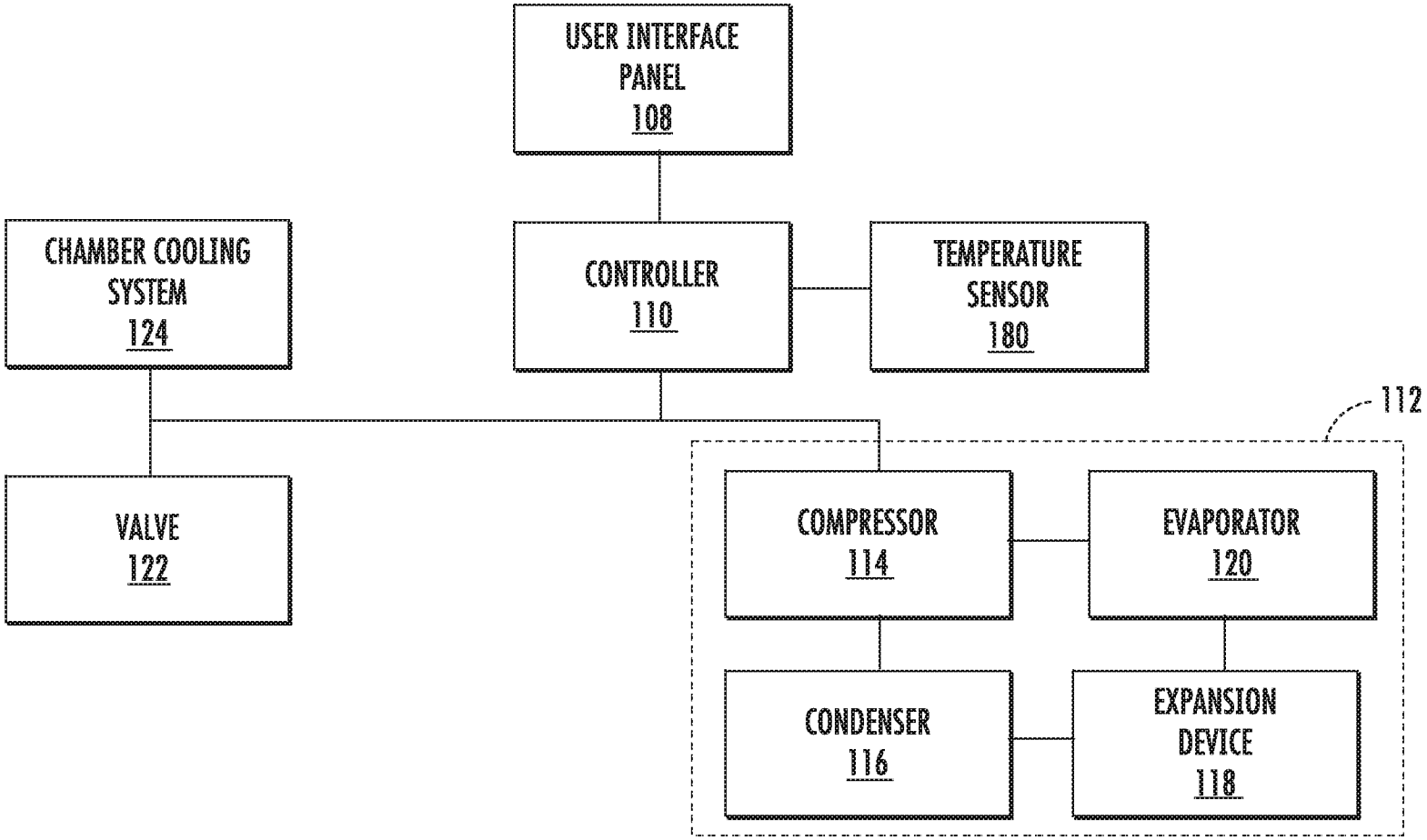
FIG. 2 provides a schematic view of an ice making assembly according to exemplary embodiments of the present disclosure.
Figure 3:
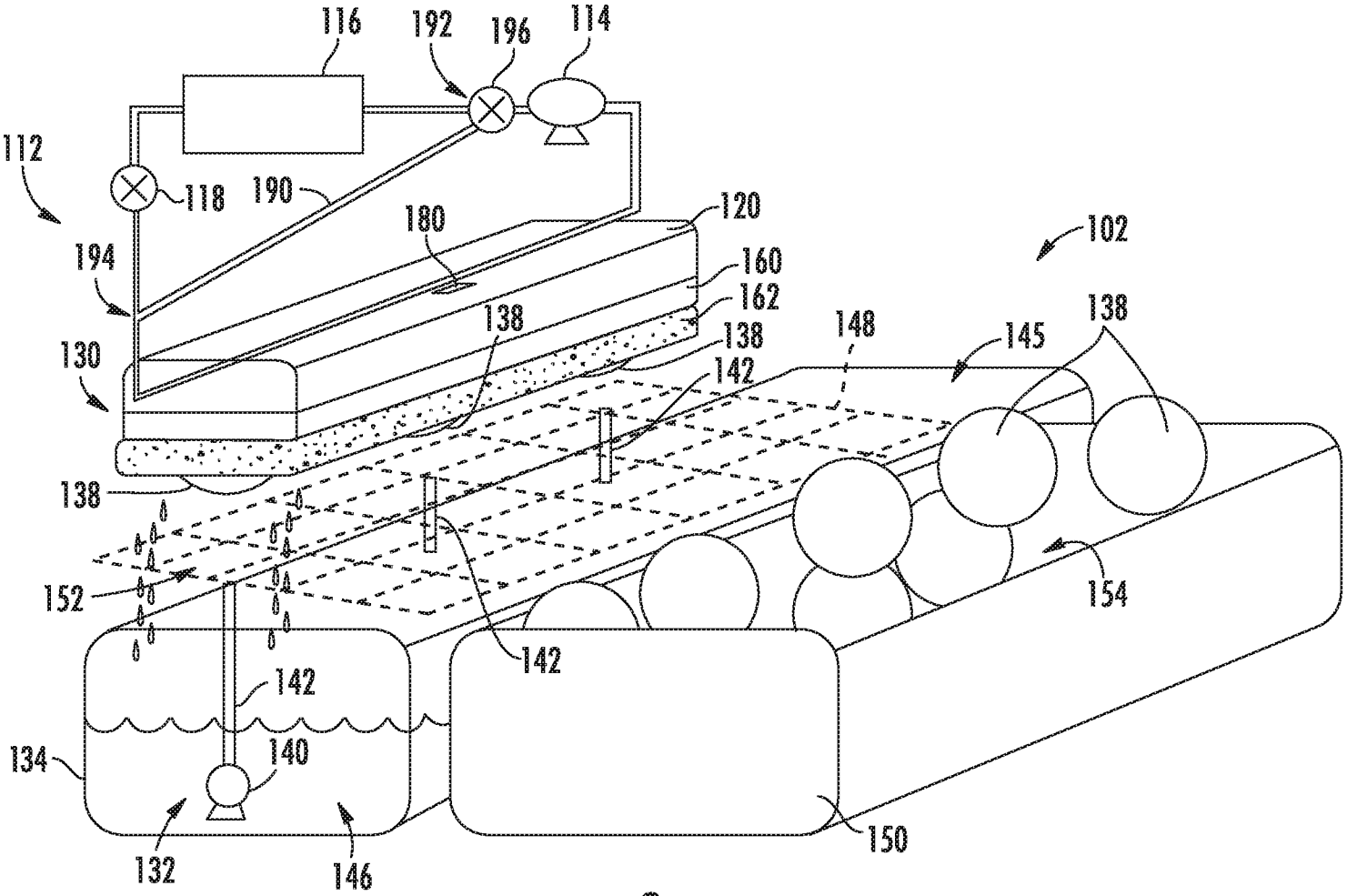
FIG. 3 provides a simplified perspective view of an ice making assembly according to exemplary embodiments of the present disclosure.

Turning now to the figures, FIG. 1 provides a side plan view of an ice making appliance 100, including an ice making assembly 102. FIG. 2 provides a schematic view of ice making assembly 102. FIG. 3 provides a simplified perspective view of ice making assembly 102. Generally, ice making appliance 100 includes a cabinet 104 (e.g., insulated housing) and defines a mutually orthogonal vertical direction V, lateral direction, and transverse direction. The lateral direction and transverse direction may be generally understood to be horizontal directions H.

As shown, cabinet 104 defines one or more chilled chambers, such as a freezer chamber 106. In certain embodiments, such as those illustrated by FIG. 1, ice making appliance 100 is understood to be formed as, or as part of, a stand-alone freezer appliance. It is recognized, however, that additional or alternative embodiments may be provided within the context of other refrigeration appliances. For instance, the benefits of the present disclosure may apply to any type or style of a refrigerator appliance that includes a freezer chamber (e.g., a top mount refrigerator appliance, a bottom mount refrigerator appliance, a side-by-side style refrigerator appliance, etc.). Consequently, the description set forth herein is for illustrative purposes only and is not intended to be limiting in any aspect to any particular chamber configuration.

Ice making appliance 100 generally includes an ice making assembly 102 on or within freezer chamber 106. In some embodiments, ice making appliance 100 includes a door 105 that is rotatably attached to cabinet 104 (e.g., at a top portion thereof). As would be understood, door 105 may selectively cover an opening defined by cabinet 104. For instance, door 105 may rotate on cabinet 104 between an open position (not pictured) permitting access to freezer chamber 106 and a closed position (FIG. 2) restricting access to freezer chamber 106.

A user interface panel 108 is provided for controlling the mode of operation. For example, user interface panel 108 may include a plurality of user inputs (not labeled), such as a touchscreen or button interface, for selecting a desired mode of operation. Operation of ice making appliance 100 can be regulated by a controller 110 that is operatively coupled to user interface panel 108 or various other components, as will be described below. User interface panel 108 provides selections for user manipulation of the operation of ice making appliance 100 such as (e.g., selections regarding chamber temperature, ice making speed, or other various options). In response to user manipulation of user interface panel 108, or one or more sensor signals, controller 110 may operate various components of the ice making appliance 100 or ice making assembly 102.

Controller 110 may include a memory (e.g., non-transitive memory) and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like; to perform control functionality instead of relying upon software).

Controller 110 may be positioned in a variety of locations throughout ice making appliance 100. In optional embodiments, controller 110 is located within the user interface panel 108. In other embodiments, the controller 110 may be positioned at any suitable location within ice making appliance 100, such as for example within cabinet 104. Input/output ("I/O") signals may be routed between controller 110 and various operational components of ice making appliance 100. For example, user interface panel 108 may be in communication with controller 110 via one or more signal lines or shared communication busses.

As illustrated, controller 110 may be in communication with the various components of ice making assembly 102 and may control operation of the various components. For example, various valves, switches, etc. may be actuatable based on commands from the controller 110. As discussed, user interface panel 108 may additionally be in communication with the controller 110. Thus, the various operations may occur based on user input or automatically through controller 110 instruction.

Figure 4:
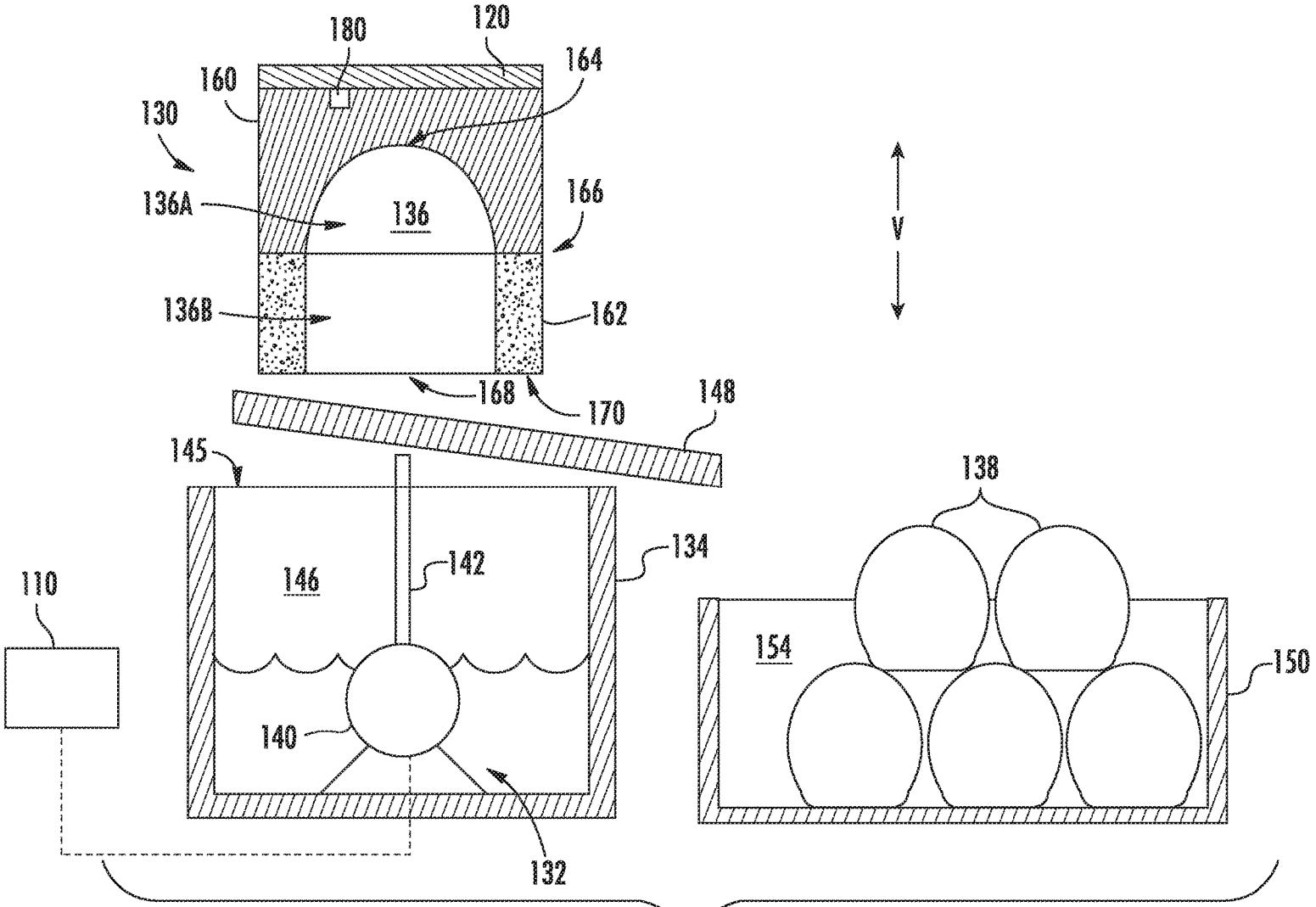
FIG. 4 provides a cross-sectional, schematic view of the exemplary ice making assembly of FIG. 3.

Generally, as shown in FIGS. 3 and 4, ice making appliance 100 includes a sealed refrigeration system 112 for executing a vapor compression cycle for cooling water within ice making appliance 100 (e.g., within freezer chamber 106). Sealed refrigeration system 112 includes a compressor 114, a condenser 116, an expansion device 118, and an evaporator 120 connected in fluid series and charged with a refrigerant. As will be understood by those skilled in the art, sealed refrigeration system 112 may include additional components (e.g., one or more directional flow valves or an additional evaporator, compressor, expansion device, or condenser). Moreover, at least one component (e.g., evaporator 120) is provided in thermal communication (e.g., conductive thermal communication) with an ice mold or mold assembly 130 (FIG. 3) to cool mold assembly 130, such as during ice making operations. Optionally, evaporator 120 is mounted within freezer chamber 106, as generally illustrated in FIG. 1.

Within sealed refrigeration system 112, gaseous refrigerant flows into compressor 114, which operates to increase the pressure of the refrigerant. This compression of the refrigerant raises its temperature, which is lowered by passing the gaseous refrigerant through condenser 116. Within condenser 116, heat exchange with ambient air takes place so as to cool the refrigerant and cause the refrigerant to condense to a liquid state.

Expansion device 118 (e.g., a mechanical valve, capillary tube, electronic expansion valve, or other restriction device) receives liquid refrigerant from condenser 116. From expansion device 118, the liquid refrigerant enters evaporator 120. Upon exiting expansion device 118 and entering evaporator 120, the liquid refrigerant drops in pressure and vaporizes. Due to the pressure drop and phase change of the refrigerant, evaporator 120 is cool relative to freezer chamber 106. As such, cooled water and ice or air is produced and refrigerates ice making appliance 100 or freezer chamber 106. Thus, evaporator 120 is a heat exchanger which transfers heat from water or air in thermal communication with evaporator 120 to refrigerant flowing through evaporator 120.

Optionally, as described in more detail below, one or more directional valves may be provided (e.g., between compressor 114 and condenser 116) to selectively redirect refrigerant through a bypass line connecting the directional valve or valves to a point in the fluid circuit downstream from the expansion device 118 and upstream from the evaporator 120. In other words, the one or more directional valves may permit refrigerant to selectively bypass the condenser 116 and expansion device 120.

In additional or alternative embodiments, ice making appliance 100 further includes a valve 122 for regulating a flow of liquid water to ice making assembly 102. For example, valve 122 may be selectively adjustable between an open configuration and a closed configuration. In the open configuration, valve 122 permits a flow of liquid water to ice making assembly 102 (e.g., to a water dispenser 132 or a water basin 134 of ice making assembly 102). Conversely, in the closed configuration, valve 122 hinders the flow of liquid water to ice making assembly 102.

In certain embodiments, ice making appliance 100 also includes a discrete chamber cooling system 124 (e.g., separate from sealed refrigeration system 112) to generally draw heat from within freezer chamber 106. For example, discrete chamber cooling system 124 may include a corresponding sealed refrigeration circuit (e.g., including a unique compressor, condenser, evaporator, and expansion device) or air handler (e.g., axial fan, centrifugal fan, etc.) configured to motivate a flow of chilled air within freezer chamber 106.

Turning now to FIGS. 3 and 4, FIG. 4 provides a cross-sectional, schematic view of ice making assembly 102. As shown, ice making assembly 102 includes a mold assembly 130 that defines a mold cavity 136 within which an ice billet 138 may be formed. Optionally, a plurality of mold cavities 136 may be defined by mold assembly 130 and spaced apart from each other (e.g., perpendicular to the vertical direction V). One or more portions of sealed refrigeration system 112 may be in thermal communication with mold assembly 130. In particular, evaporator 120 may be placed on or in contact (e.g., conductive contact) with a portion of mold assembly 130. During use, evaporator 120 may selectively draw heat from mold cavity 136, as will be further described below. Moreover, a water dispenser 132 positioned below mold assembly 130 may selectively direct the flow of water into mold cavity 136. Generally, water dispenser 132 includes a water pump 140 and at least one nozzle 142 directed (e.g., vertically) toward mold cavity 136. In embodiments wherein multiple discrete mold cavities 136 are defined by mold assembly 130, water dispenser 132 may include a plurality of nozzles 142 or fluid pumps vertically aligned with the plurality mold cavities 136. For instance, each mold cavity 136 may be vertically aligned with a discrete nozzle 142.

In some embodiments, a water basin 134 is positioned below the ice mold (e.g., directly beneath mold cavity 136 along the vertical direction V). Water basin 134 includes a solid nonpermeable body and may define a vertical opening 145 and interior volume 146 in fluid communication with mold cavity 136. When assembled, fluids, such as excess water falling from mold cavity 136, may pass into interior volume 146 of water basin 134 through vertical opening 145. In certain embodiments, one or more portions of water dispenser 132 are positioned within water basin 134 (e.g., within interior volume 146). As an example, water pump 140 may be mounted within water basin 134 in fluid communication with interior volume 146. Thus, water pump 140 may selectively draw water from interior volume 146

(e.g., to be dispensed by spray nozzle 142). Nozzle 142 may extend (e.g., vertically) from water pump 140 through interior volume 146.

In certain embodiments, a guide ramp 148 is positioned between mold assembly 130 and water basin 134 along the vertical direction V. For example, guide ramp 148 may include a ramp surface that extends at a negative angle (e.g., relative to a horizontal direction) from a location beneath mold cavity 136 to another location spaced apart from water basin 134 (e.g., horizontally). In some such embodiments, guide ramp 148 extends to or terminates above an ice bin 150. Optionally, guide ramp 148 may define a perforated portion 152 that is, for example, vertically aligned between mold cavity 136 and nozzle 142 or between mold cavity 136 and interior volume 146. One or more apertures are generally defined through guide ramp 148 at perforated portion 152. Fluids, such as water, may thus generally pass through perforated portion 152 of guide ramp 148 (e.g., along the vertical direction V between mold cavity 136 and interior volume 146).

As shown, ice bin 150 generally defines a storage volume 154 and may be positioned below mold assembly 130 and mold cavity 136. Ice billets 138 formed within mold cavity 136 may be expelled from mold assembly 130 and subsequently stored within storage volume 154 of ice bin 150 (e.g., within freezer chamber 106). In some such embodiments, ice bin 150 is positioned within freezer chamber 106 and horizontally spaced apart from water basin 134, water dispenser 132, or mold assembly 130. Guide ramp 148 may span the horizontal distance between mold assembly 130 and ice bin 150. As ice billets 138 descend or fall from mold cavity 136, the ice billets 138 may thus be motivated (e.g., by gravity) toward ice bin 150.

Figure 5:
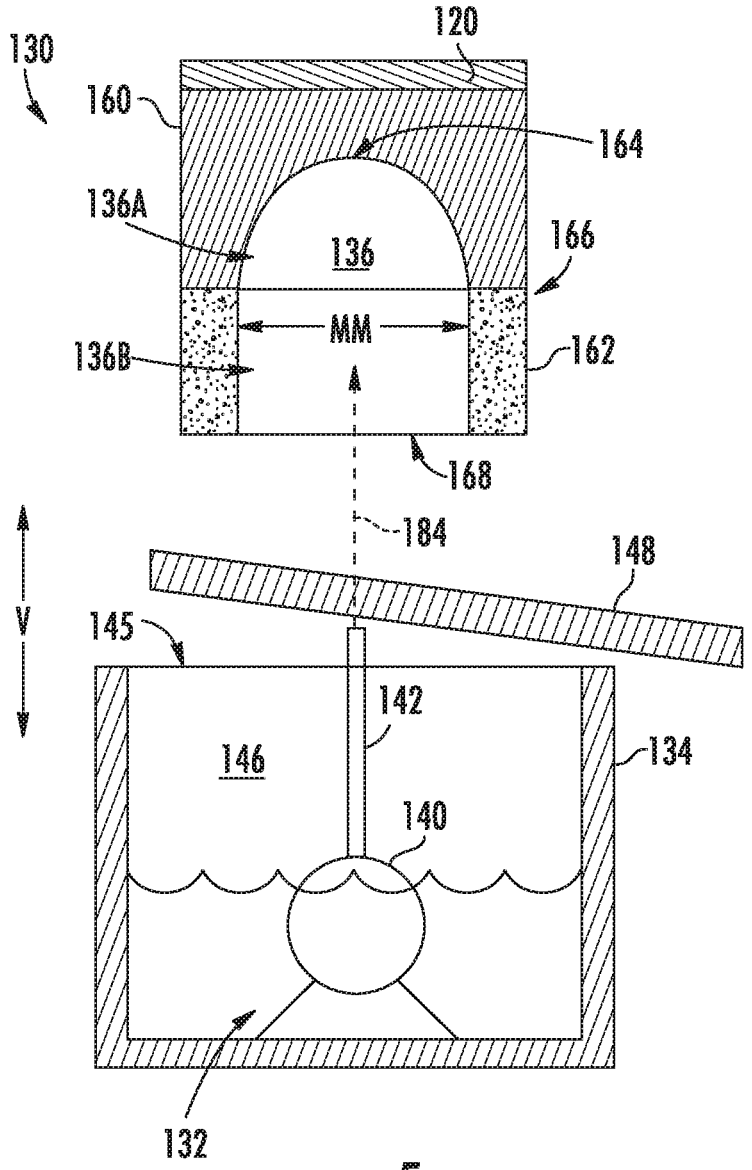
FIG. 5 provides a cross-sectional, schematic view of a portion of the exemplary ice making assembly of FIG. 3 during an ice forming operation.

Turning now generally to FIGS. 4 and 5, exemplary ice forming operations of ice making assembly 102 will be described. As shown, mold assembly 130 is formed from discrete conductive ice mold 160 and insulation jacket 162. Generally, insulation jacket 162 extends downward from (e.g., directly from) conductive ice mold 160. For instance, insulation jacket 162 may be fixed to conductive ice mold 160 through one or more suitable adhesives or attachment fasteners (e.g., bolts, latches, mated prongs-channels, etc.) positioned or formed between conductive ice mold 160 and insulation jacket 162.

Together, conductive ice mold 160 and insulation jacket 162 may define mold cavity 136. For instance, conductive ice mold 160 may define an upper portion 136A of mold cavity 136 while insulation jacket 162 defines a lower portion 136B of mold cavity 136. Upper portion 136A of mold cavity 136 may extend between a nonpermeable top end 164 and an open bottom end 166. Additionally or alternatively, upper portion 136A of mold cavity 136 may be curved (e.g., hemispherical) in open fluid communication with lower portion 136B of mold cavity 136. Lower portion 136B of mold cavity 136 may be a vertically open passage that is aligned (e.g., in the vertical direction V) with upper portion 136A of mold cavity 136. Thus, mold cavity 136 may extend along the vertical direction between a mold opening 168 at a bottom portion or bottom surface 170 of insulation jacket 162 to top end 164 within conductive ice mold 160. In some such embodiments, mold cavity 136 defines a constant diameter or horizontal width from lower portion 136B to upper portion 136A. When assembled, fluids, such as water may pass to upper portion 136A of mold cavity 136 through lower portion 136B of mold cavity 136 (e.g., after flowing through the bottom opening defined by insulation jacket 162).

Conductive ice mold 160 and insulation jacket 162 are formed, at least in part, from two different materials. Conductive ice mold 160 is generally formed from a thermally conductive material (e.g., metal, such as copper, aluminum, or stainless steel, including alloys thereof) while insulation jacket 162 is generally formed from a thermally insulating material (e.g., insulating polymer, such as a synthetic silicone configured for use within subfreezing temperatures without significant deterioration). According to alternative embodiments, insulation jacket 162 may be formed using polyethylene terephthalate (PET) plastic or any other suitable material. In some embodiments, conductive ice mold 160 is formed from material having a greater amount of water surface adhesion than the material from which insulation jacket 162 is formed. Water freezing within mold cavity 136 may be prevented from extending horizontally along bottom surface 170 of insulation jacket 162.

Advantageously, an ice billet within mold cavity 136 may be prevented from mushrooming beyond the bounds of mold cavity 136. Moreover, if multiple mold cavities 136 are defined within mold assembly 130, ice making assembly 102 may advantageously prevent a connecting layer of ice from being formed along the bottom surface 170 of insulation jacket 162 between the separate mold cavities 136 (and ice billets therein). Further advantageously, the present embodiments may ensure an even heat distribution across an ice billet within mold cavity 136. Cracking of the ice billet or formation of a concave dimple at the bottom of the ice billet may thus be prevented.

In some embodiments, the unique materials of conductive ice mold 160 and insulation jacket 162 each extend to the surfaces defining upper portion 136A and lower portion 136B of mold cavity 136. In particular, a material having a relatively high water adhesion may define the bounds of upper portion 136A of mold cavity 136 while a material having a relatively low water adhesion defines the bounds of lower portion 136B of mold cavity 136. For instance, the surface of insulation jacket 162 defining the bounds of lower portion 136B of mold cavity 136 may be formed from an insulating polymer (e.g., silicone). The surface of conductive mold cavity 136 defining the bounds of upper portion 136A of mold cavity 136 may be formed from a thermally conductive metal (e.g., aluminum or copper). In some such embodiments, the thermally conductive metal of conductive ice mold 160 may extend along (e.g., the entirety of) of upper portion 136A.

Although an exemplary mold assembly 130 is described above, it should be appreciated that variations and modifications may be made to mold assembly 130 while remaining within the scope of the present disclosure. For example, the size, number, position, and geometry of mold cavities 136 may vary. In addition, according to alternative embodiments, an insulation film may extend along and define the bounds of upper portion 136A of mold cavity 136 (e.g., may extend along an inner surface of conductive ice mold 160 at upper portion 136A of mold cavity 136). Indeed, aspects of the present disclosure may be modified and implemented in a different ice making apparatus or process while remaining within the scope of the present disclosure.

In some embodiments, one or more sensors are mounted on or within ice mold 160. As an example, a temperature sensor 180 may be mounted adjacent to ice mold 160. Temperature sensor 180 may be electrically coupled to controller 110 and configured to detect the temperature within ice mold 160. Temperature sensor 180 may be formed as any suitable temperature detecting device, such as a thermocouple, thermistor, etc. Although temperature sensor 180 is illustrated as being mounted to ice mold 160, it should be appreciated that according to alternative embodiments, temperature sensor may be positioned at any other suitable location for providing data indicative of the temperature of the ice mold 160. For example, temperature sensor 180 may alternatively be mounted to a coil of evaporator 120 or at any other suitable location within ice making appliance 100.

As shown, controller 110 may be in communication (e.g., electrical communication) with one or more portions of ice making assembly 102. In some embodiments, controller 110 is in communication with one or more fluid pumps (e.g., water pump 140), compressor 114, flow regulating valves, etc. Controller 110 may be configured to initiate discrete ice making operations and ice release operations. For instance, controller 110 may alternate the fluid source spray to mold cavity 136 and a release or ice harvest process, which will be described in more detail below.

During ice making operations, controller 110 may initiate or direct water dispenser 132 to motivate an ice-building spray (e.g., as indicated at arrows 184) through nozzle 142 and into mold cavity 136 (e.g., through mold opening 168). Controller 110 may further direct sealed refrigeration system 112 (e.g., at compressor 114) (FIG. 3) to motivate refrigerant through evaporator 120 and draw heat from within mold cavity 136. As the water from the ice-building spray 184 strikes mold assembly 130 within mold cavity 136, a portion of the water may freeze in progressive layers from top end 164 to bottom end 166. Excess water (e.g., water within mold cavity 136 that does not freeze upon contact with mold assembly 130 or the frozen volume herein) and impurities within the ice-building spray 184 may fall from mold cavity 136 and, for example, to water basin 134.

Once ice billets 138 are formed within mold cavity 136, an ice release or harvest process may be performed in accordance with embodiments of the present disclosure. Specifically, referring again to FIG. 3, sealed system 112 may further include a bypass conduit 190 that is fluidly coupled to refrigeration loop or sealed system 112 for routing a portion of the flow of refrigerant around condenser 116. In this manner, by selectively regulating the amount of relatively hot refrigerant flow that exits compressor 114 and bypasses condenser 116, the temperature of the flow of refrigerant passing into evaporator 120 may be precisely regulated.

Specifically, according to the illustrated embodiment, bypass conduit 190 extends from a first junction 192 to a second junction 194 within sealed system 112. First junction 192 is located between compressor 114 and condenser 116 (e.g., downstream of compressor 114 and upstream of condenser 116). By contrast, second junction 194 is located between condenser 116 and evaporator 120 (e.g., downstream of condenser 116 and upstream of evaporator 120). Moreover, according to the illustrated embodiment, second junction 194 is also located downstream of expansion device 118, although second junction 194 could alternatively be positioned upstream of expansion device 118. When plumbed in this manner, bypass conduit 190 provides a pathway through which a portion of the flow of refrigerant may pass directly from compressor 114 to a location immediately upstream of evaporator 120 to increase the temperature of evaporator 120.

Notably, if substantially all of the flow of refrigerant were diverted from compressor 114 through bypass conduit 190 when ice mold 160 is still very cold (e.g., below 10° F. or 20° F.), the thermal shock experienced by ice billets 138 due to the sudden increase in evaporator temperature might cause ice billets 138 to crack. Therefore, controller 110 may implement methods for slowly regulating or precisely controlling the evaporator temperature to achieve the desired mold temperature profile and harvest release time to prevent the ice billets 138 from cracking.

In this regard, for example, bypass conduit 190 may be fluidly coupled to sealed system 112 using a flow regulating device 196. Specifically, flow regulating device 196 may be used to couple bypass conduit 190 to sealed system 112 at first junction 192. In general, flow regulating device 196 may be any device suitable for regulating a flow rate of refrigerant through bypass conduit 190. For example, according to an exemplary embodiment of the present disclosure, flow regulating device 196 is an electronic expansion device which may selectively divert a portion of the flow of refrigerant exiting compressor 114 into bypass conduit 190. According to still another embodiment, flow regulating device 196 may be a servomotor-controlled valve for regulating the flow of refrigerant through bypass conduit 190. According to still other embodiments, flow regulating device 196 may be a three-way valve mounted at first junction 192 or a solenoid-controlled valve operably coupled along bypass conduit 190.

According to exemplary embodiments of the present disclosure, controller 110 may initiate an ice release or harvest process to discharge ice billets 138 from mold cavities 136. Specifically, for example, controller 110 may first halt or prevent the ice-building spray 184 by de-energizing water pump 140. Next, controller 110 may regulate the operation of sealed system 112 to slowly increase a temperature of evaporator 120 and ice mold 160. Specifically, by increasing the temperature of evaporator 120, the mold temperature of ice mold 160 is also increased, thereby facilitating partial melting or release of ice billets 138 from mold cavities.

According to exemplary embodiments, controller 110 may be operably coupled to flow regulating device 196 for regulating a flow rate of the flow of refrigerant through bypass conduit 190. Specifically, according to an exemplary embodiment, controller 110 may be configured for obtaining a mold temperature of the mold body using temperature sensor 180. Although the term "mold temperature" is used herein, it should be appreciated that temperature sensor 180 may measure any suitable temperature within the ice making appliance 100 that is indicative of mold temperature and may be used to facilitate improved harvest of ice billets 138.

Controller 110 may further regulate the flow regulating device 196 to control the flow of refrigerant based in part on the measured mold temperature. For example, according to an exemplary embodiment, flow regulating device 196 may be regulated such that a rate of change of the mold temperature does not exceed a predetermined threshold rate. For example, this predetermined threshold rate may be any suitable rate of temperature change beyond which thermal cracking of ice billets 138 may occur. For example, according to an exemplary embodiment, the predetermined threshold rate may be approximately 1° F. per minute, about 2° F. per minute, about 3° F. per minute, or higher. According to exemplary embodiments, the predetermined threshold rate may be less than 10° F. per minute, less than 5° F. permanent, less than 2° F. per minute, or lower. In this manner, flow regulating device 196 may regulate the rate of temperature change of ice billets 138, thereby preventing thermal cracking.

In general, the sealed system 112 and methods of operation described herein are intended to regulate a temperature change of ice billets 138 to prevent thermal cracking. However, although specific control algorithms and system configurations are described, it should be appreciated that according to alternative embodiments variations and modifications may be made to such systems and methods while remaining within the scope of the present disclosure. For example, the exact plumbing of bypass conduit 190 may vary, the type or position of flow regulating device 196 may change, and different control methods may be used while remaining within scope of the present disclosure. In addition, depending on the size and shape of ice billets 138, the predetermined threshold rate and predetermined temperature threshold may be adjusted to prevent that particular set of ice billets 138 from cracking, or to otherwise facilitate an improved harvest procedure.

Figure 6:
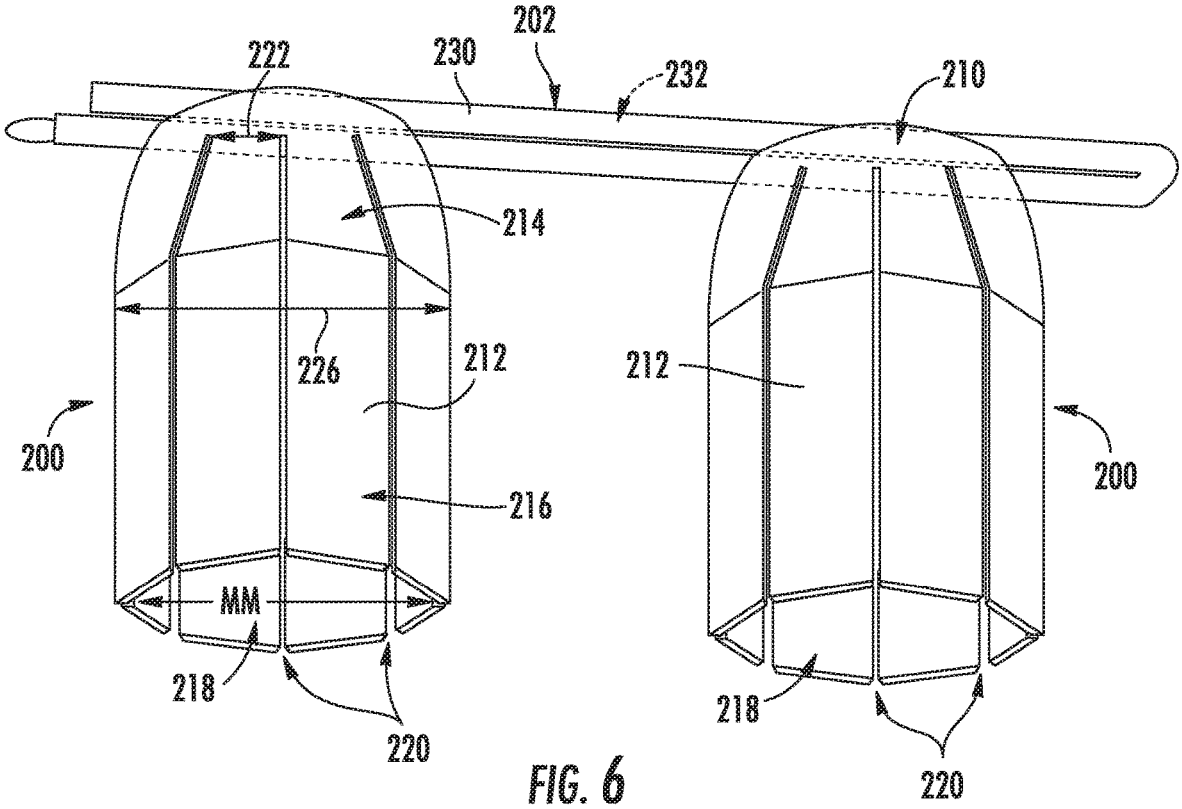
FIG. 6 provides a bottom perspective view of an ice mold and an evaporator assembly according to exemplary embodiments of the present disclosure.
Figure 7:
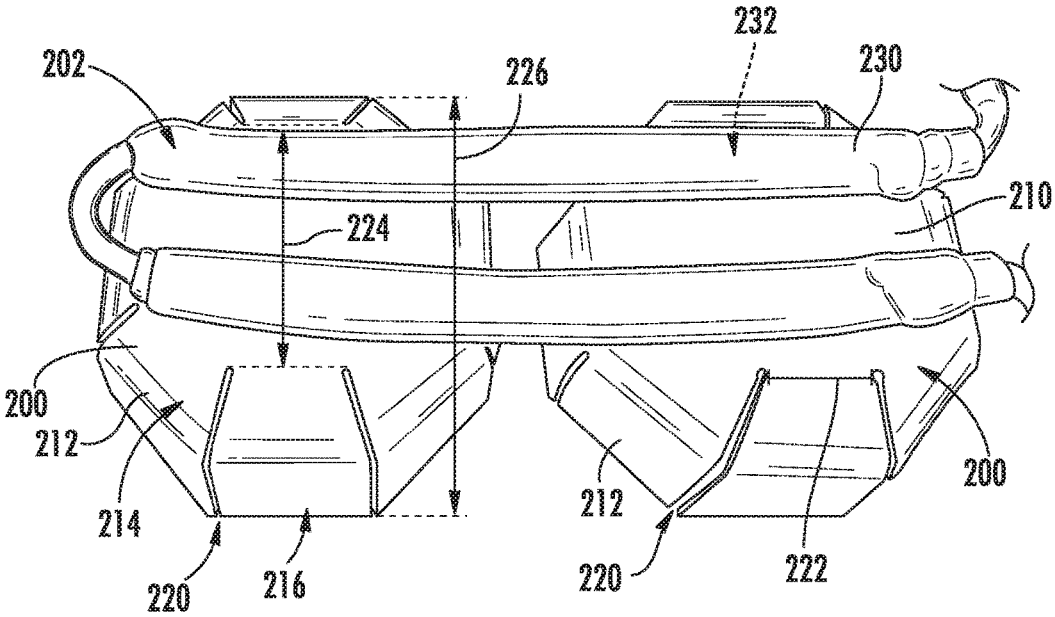
FIG. 7 provides a top perspective view of the exemplary ice mold and evaporator assembly of FIG. 6 according to exemplary embodiments of the present disclosure.
Figure 8:
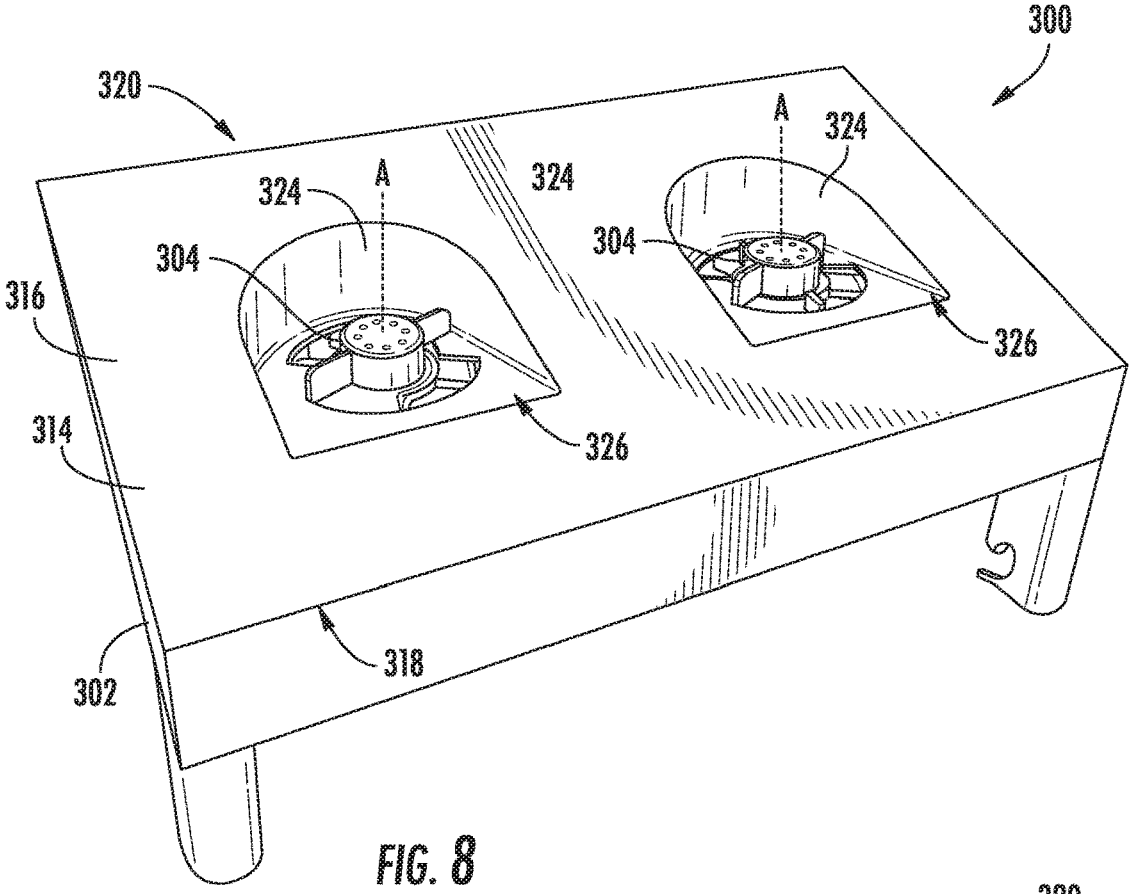
FIG. 8 provides a perspective view of a water dispensing assembly according to exemplary embodiments of the present disclosure.
Figure 9:
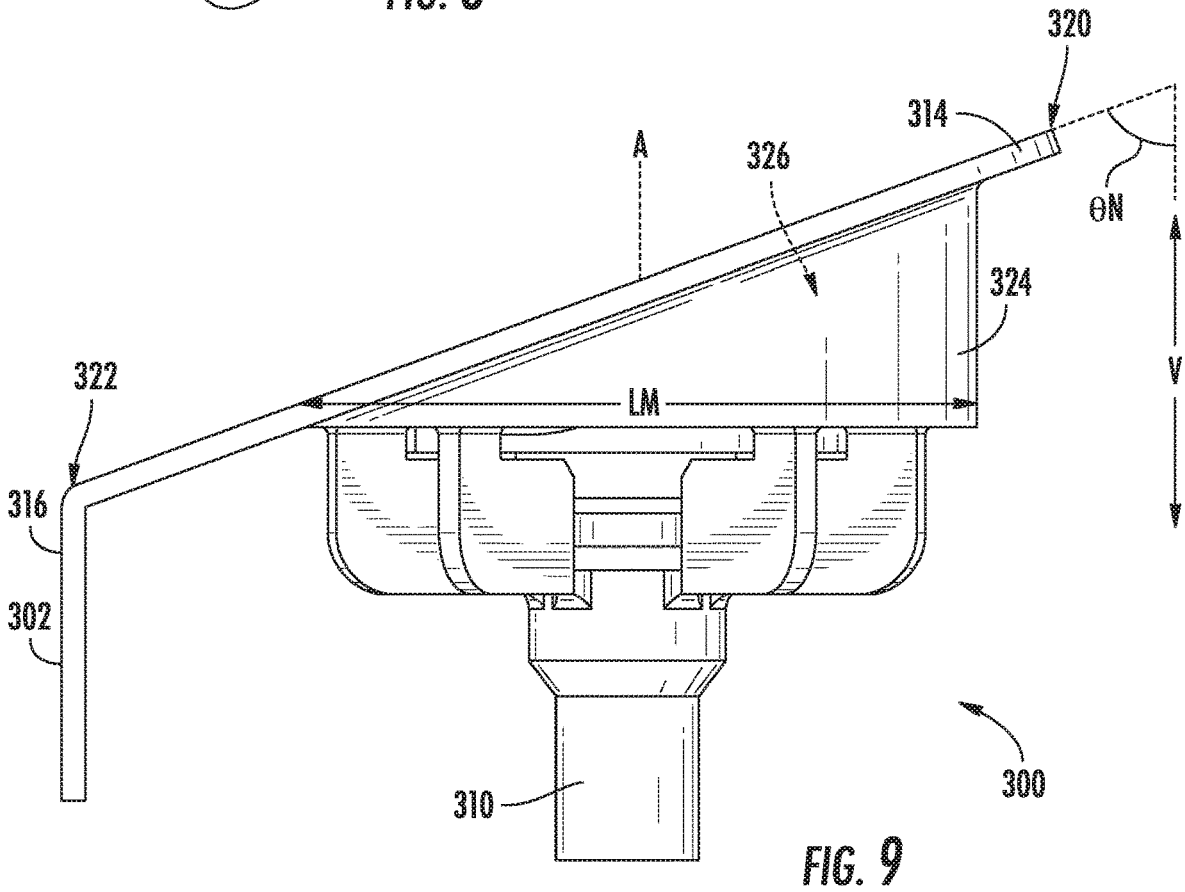
FIG. 9 provides an elevation view of the exemplary water dispensing assembly of FIG. 8.
Figure 10:
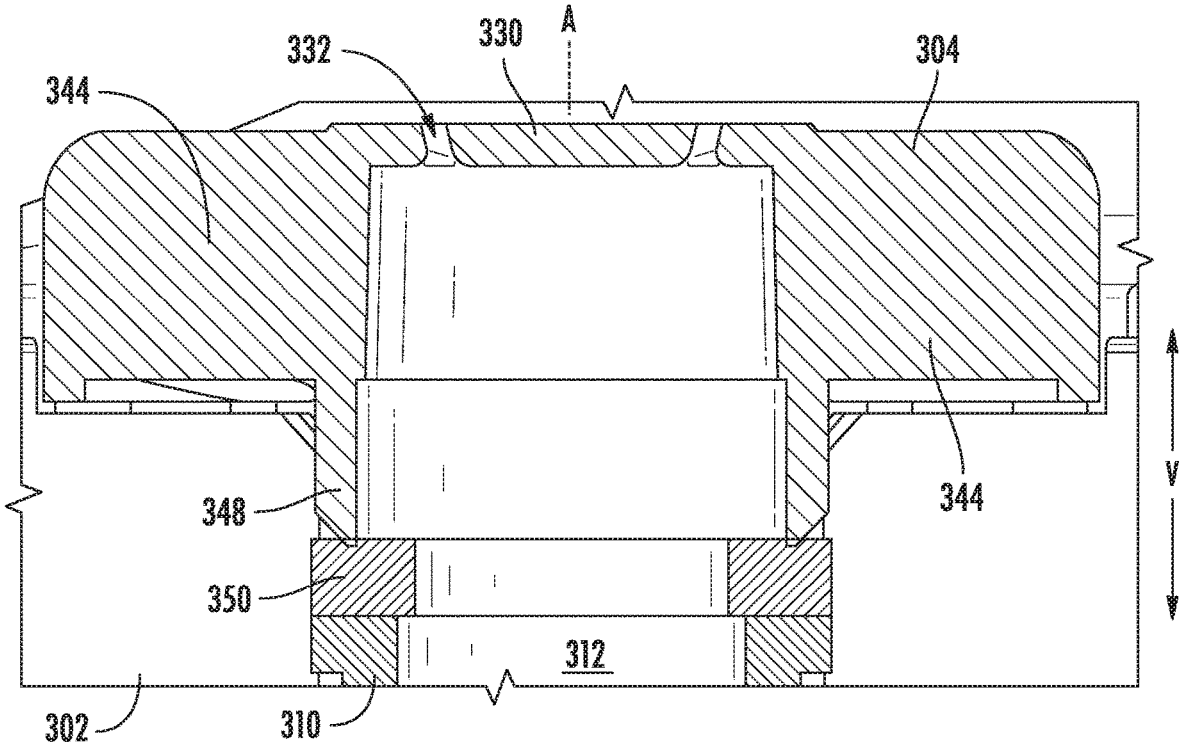
FIG. 10 provides a sectional, elevation view of a portion of the exemplary water dispensing assembly of FIG. 8.
Figure 11:
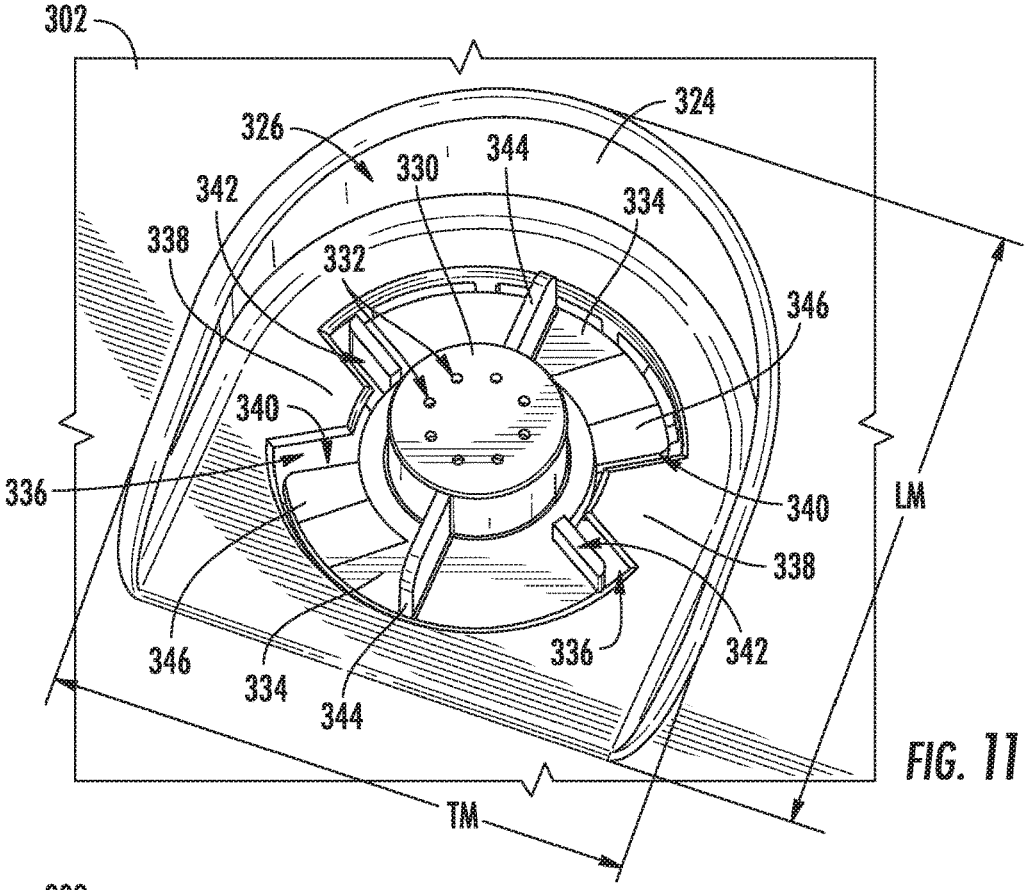
FIG. 11 provides a perspective view of a removable nozzle of the exemplary water dispensing assembly of FIG. 8, wherein the removable nozzle is in an unsecured position.
Figure 12:
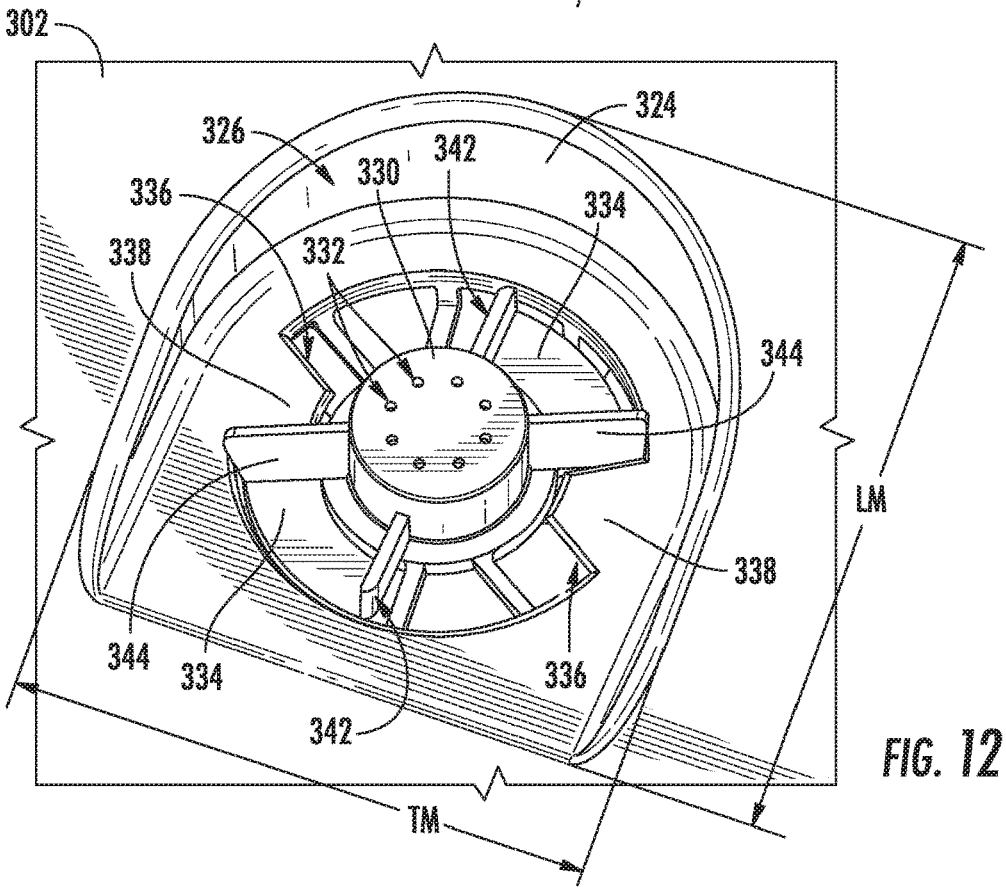
FIG. 12 provides a perspective view of a removable nozzle of the exemplary water dispensing assembly of FIG. 8, wherein the removable nozzle is in a secured position.

Referring now specifically to FIGS. 6 and 7, an exemplary ice mold 200 and evaporator assembly 202 that may be used with ice making appliance 100 will be described according to exemplary embodiments of the present disclosure. Specifically, for example, ice mold 200 may be used as mold assembly 130 and evaporator assembly 202 may be used as evaporator 120 of sealed cooling system 112. Although ice mold 200 and evaporator assembly 202 are described herein with respect to ice making appliance 100, it should be appreciated that ice mold 200 and evaporator assembly 202 may be used in any other suitable ice making application or appliance.

As shown, ice mold 200 generally includes a top wall 210 and a plurality of sidewalls 212 that are cantilevered from top wall 210 and extend downward from top wall 210. More specifically, according to the illustrated embodiment, ice mold 200 includes eight sidewalls 212 that include an angled portion 214 that extends away from top wall 210 and a vertical portion 216 that extends down from angled portion 214 substantially along the vertical direction. In this manner, the top wall 210 and the plurality of sidewalls 212 form a mold cavity 218 having an octagonal cross-section when viewed in a horizontal plane. In addition, each of the plurality of sidewalls 212 may be separated by a gap 220 that extends substantially along the vertical direction. In this manner, the plurality of sidewalls 212 may move relative to each other and act as spring fingers to permit some flexing of ice mold 200 during ice formation. Notably, this flexibility of ice mold 200 facilitates improved ice formation and reduces the likelihood of cracking.

In general, ice mold 200 may be formed from any suitable material and in any suitable manner that provides sufficient thermal conductivity to transfer heat to evaporator assembly 202 to facilitate the ice making process. According to an exemplary embodiment, ice mold 200 is formed from a single sheet of copper. In this regard, for example, a flat sheet of copper having a constant thickness may be machined to define top wall 210 and sidewalls 212. Sidewalls 212 may be subsequently bent to form the desired shape of mold cavity 218 (e.g., such as the octagonal or gem shape described above). In this manner, top wall 210 and sidewalls 212 may be formed to have an identical thickness without requiring complex and costly machining processes.

According exemplary embodiments of the present disclosure, evaporator assembly 202 is mounted in direct contact with the top wall 210 of ice mold 200. In addition, evaporator assembly 202 may not be in direct contact with sidewalls 212. This may be desirable, for example, to prevent restricting the movement of sidewalls 212 (e.g., to reduce to the likelihood of ice cracking). Notably, when evaporator assembly 202 is mounted only on top wall 210, the conductive path to each of the plurality of sidewalls 212 is through the joint or connection where sidewalls 212 meet top wall 210. Thus, it may be desirable to make a sidewall width 222 as large as possible to provide improved thermal conductivity. For example, the sidewall width 222 may be between about 0.5 and 1.5 inches, between about 0.7 and 1 inches, or about 0.8 inches. Such a sidewall width 222 facilitates the conduction of thermal energy to the bottom ends of each of the plurality of sidewalls 212.

In addition, to improve the thermal contact between evaporator assembly 202 and ice mold 200, it may be desirable to make top wall relatively large. Therefore, according to exemplary embodiments, top wall 210 may define a top width 224 and mold cavity 218 may define a max width 226. According to exemplary embodiments, top width 224 is greater than about 50% of max width 226. According to still other embodiments, top width 224 may be greater than about 60%, greater than about 70%, greater than about 80%, or greater, of max width 226. In addition, or alternatively, top width 224 may be less than 90%, less than 70%, less than 60%, less than 50%, or less, of max width 226. It should be appreciated that other suitable sizes, geometries, and configurations of ice mold 200 are possible and within the scope of the present disclosure. In addition, although only two ice molds 200 are illustrated in FIGS. 6 and 7, it should be appreciated that alternative embodiments may include any other suitable number and configuration of ice molds 200.

Referring still to FIGS. 6 and 7, evaporator assembly 202 may generally include a primary evaporator tube 230 and a thermal enhancement structure 232 which is positioned within primary evaporator tube 230. According to an exemplary embodiment, primary evaporator tube may be a copper pipe having a circular cross section. The diameter of primary evaporator tube 230 may be between about 0.1 and 3 inches, between about 0.2 and 2 inches, between about 0.3 and 1 inches, between about 0.4 and 0.8 inches, or about 0.5 inches. However, it should be appreciated that primary evaporator tube 230 may be any other suitable size, shape, length, and material.

As used herein, "thermal enhancement structure" is generally intended to refer to any suitable material, structure, or features within interior of primary evaporator tube 230 which are intended to increase the refrigerant side surface area within primary evaporator tube 230. For example, thermal enhancement structure 232 may be a plurality of internal tubes that are stacked within primary evaporator tube 230. In general, these internal tubes may be copper pipes that have a smaller diameter than primary evaporator tube 230. Internal tubes may be stacked in primary evaporator tube 230 and extend approximately the same length as primary evaporator tube 230. Additionally or alternatively, thermal enhancement structure 232 may include a copper foam or mesh structure, a honeycomb structure, a lattice structure, or any other suitable thermally conductive material that extends from the internal walls of primary evaporator tube 230 through the center of primary evaporator tube 230 to increase the refrigerant side surface area. It should be appreciated that any other suitable thermal enhancement structure 232 may be used while remaining within the scope of the present disclosure.

As shown generally in FIGS. 6 and 7, primary evaporator tube 230 may be placed in direct contact with the top wall 210 of ice mold 200 and may have improved thermal contact with the top wall 210. Once formed, evaporator assembly 202 may be used with sealed cooling system 112. In this manner, for example, compressor 114 may urge a flow of refrigerant through condenser 116, expansion device 118, and evaporator assembly 202, as described above.

Referring now specifically to FIGS. 8 through 12, an exemplary water dispenser assembly 300, including a dispenser base 302 and one or more removable spray caps 304, that may be used with ice making appliance 100 will be described according to exemplary embodiments of the present disclosure. Specifically, for example, water dispenser assembly 300 may be used as (or as part of) water dispenser 132. For instance, dispenser base 302 and spray cap 304 may be used as (or as part of) guide ramp 148 and nozzle 142 (e.g., FIG. 4), respectively. Thus, water dispenser 300 may be positioned below (e.g., directly below) the ice mold 130 or 200 to direct an ice-building spray of water to the mold cavity 136 or 218 (e.g., FIGS. 4 and 6). Although dispenser assembly 300 is described herein with respect to ice making appliance 100, it should be appreciated that dispenser assembly 300 may be used in any other suitable ice making application or appliance. Moreover, although two discrete spray caps 304 are illustrated to provide a corresponding number of ice-building sprays to ice molds thereabove, any suitable number of spray caps (and thus corresponding ice molds) may be provided, as would be understood in light of the present disclosure.

As shown, the dispenser base 302 generally defines one or more water paths 312 through which water may flow to a corresponding spray cap 304. For instance, one or more conduits 310 may be provided to or beneath spray cap 304 and define water path 312 Thus, water path 312 may be upstream from the spray cap 304. Moreover, when assembled water path 312 may be upstream from pump 140 (FIG. 3), as would be understood in light of the present disclosure.

In some embodiments, the conduits 310 of dispenser base 302 are joined to a support deck 314 (e.g., as discrete or, alternatively, integral unitary member) on which spray cap 304 is selectively received. Support deck 314 may define a guide ramp 316 having a ramp surface that extends at a non-vertical angle θN (e.g., negative angle relative to a horizontal direction) from an upper edge 320 to a lower edge 322. When assembled the ice mold 130 or 200 (e.g., FIGS. 4 and 6) may be vertically aligned below support deck 314 between the upper edge 320 and the lower edge 322 such that falling ice billets may strike guide ramp 316 and roll therealong (e.g., as motivated by gravity) to the lower edge 322. From the lower edge 322, ice billets may further roll into an ice bin (e.g., 150—FIG. 2), as described above. Optionally, guide ramp 316 may define a perforated portion, as further described above. Alternatively, guide ramp 316 may define a solid, non-permeable guide surface.

In certain embodiments, support deck 314 includes a cup wall 324 that defines a nozzle recess 326 within which a corresponding spray cap 304 is received. For instance, cup wall 324 may extend from or above conduit 310 such that nozzle recess 326 is defined as a vertically-open cavity through which the ice-building may flow. As shown, cup wall 324 and nozzle recess 326 may be positioned between upper edge 320 and lower edge 322. When assembled, nozzle recess 326 may thus be defined beneath or below at least a portion of guide ramp 316. For instance, a bottom surface of cup wall 324 may extend horizontally from the ramp surface of guide ramp 316 towards upper edge 320. In other words, the bottom surface of cup wall 324 may extend away from lower edge 322 and fail to cross a forward plane defined by the ramp surface along the non-vertical angle θN. The resulting nozzle recess 326 may, in turn, have a side profile that is shaped as a right triangle (e.g., enclosed within the triangular side profile of support deck 314).

Generally, nozzle recess 326 defines a horizontal profile having one or more horizontal maximums. For instance, in the illustrated embodiments, nozzle recess 326 defines a lateral maximum LM and a transverse maximum TM that is larger than the lateral maximum LM. Alternative embodiments may have a circular profile and, thus, a single horizontal maximum or diameter. In certain embodiments, the maximum horizontal recess width (i.e., largest horizontal maximum of nozzle recess 326, such as lateral maximum LM) is smaller than a maximum horizontal mold width MM (FIGS. 5 and 6) of mold cavity 136, 218 (e.g., 226). In other words, the maximum horizontal mold width MM, which at least partially defines ice billets formed therein, is larger than the maximum horizontal recess width of nozzle recess 326. Thus, the ice billets formed in (and released from) ice mold are generally larger than the opening to nozzle recess 326.

In optional embodiments, the maximum horizontal mold width MM is at least 50 percent larger than the maximum horizontal recess width (e.g., lateral maximum LM). In additional or alternative embodiments, the maximum horizontal recess width (e.g., lateral maximum LM) is less or equal to than 1.5 inches. In further additional or alternative embodiments, the maximum horizontal mold width MM is greater than or equal to 3 inches. In still further additional or alternative embodiments, the maximum horizontal mold width MM is about 1.5 inches while the maximum horizontal recess width is about 3 inches.

Advantageously, ice billets may be prevented from falling into nozzle recess 326 or otherwise blocking the ice-building spray from spray cap 304.

As shown, spray cap 304 may be positioned on at least a portion of dispenser base 302 (e.g., within nozzle recess 326). Specifically, spray cap 304 is mountable downstream from water path 312 to direct an ice-building spray therefrom (e.g., along a vertical spray axis A towards a corresponding mold cavity 136, 218—FIGS. 4 and 6). Generally, spray cap 304 includes a nozzle head 330 through which one or more outlet apertures 332 are defined. In particular, spray cap 304 extends across the vertical spray axis A while the outlet apertures 332 extend upward through spray cap 304. As water flows from the water path 312, it may thus flow through the outlet apertures 332 as the ice-building spray.

In some embodiments, multiple outlet apertures 332 are defined by spray cap 304 at discrete locations. Thus, the outlet apertures 332 may be spaced apart from each other (e.g., in a horizontal direction) on spray cap 304. As an example, the outlet apertures 332 may be circumferentially spaced apart about the vertical spray axis A. Thus, the outlet apertures 332 may be radially spaced apart from the vertical spray axis A. As shown, the outlet apertures 332 may form a ring or circle on the top of nozzle head 330. Optionally, one or more of the outlet apertures 332 may angled radially outward from the vertical spray axis A. Thus, water sprayed therefrom may travel at an angle that is neither parallel nor perpendicular to the vertical spray axis A. In some such embodiments, the angle of the outlet apertures 332 is less than 45 degrees relative to the vertical spray axis A (i.e., closer to parallel than perpendicular relative to the vertical spray axis A).

Figure 13:
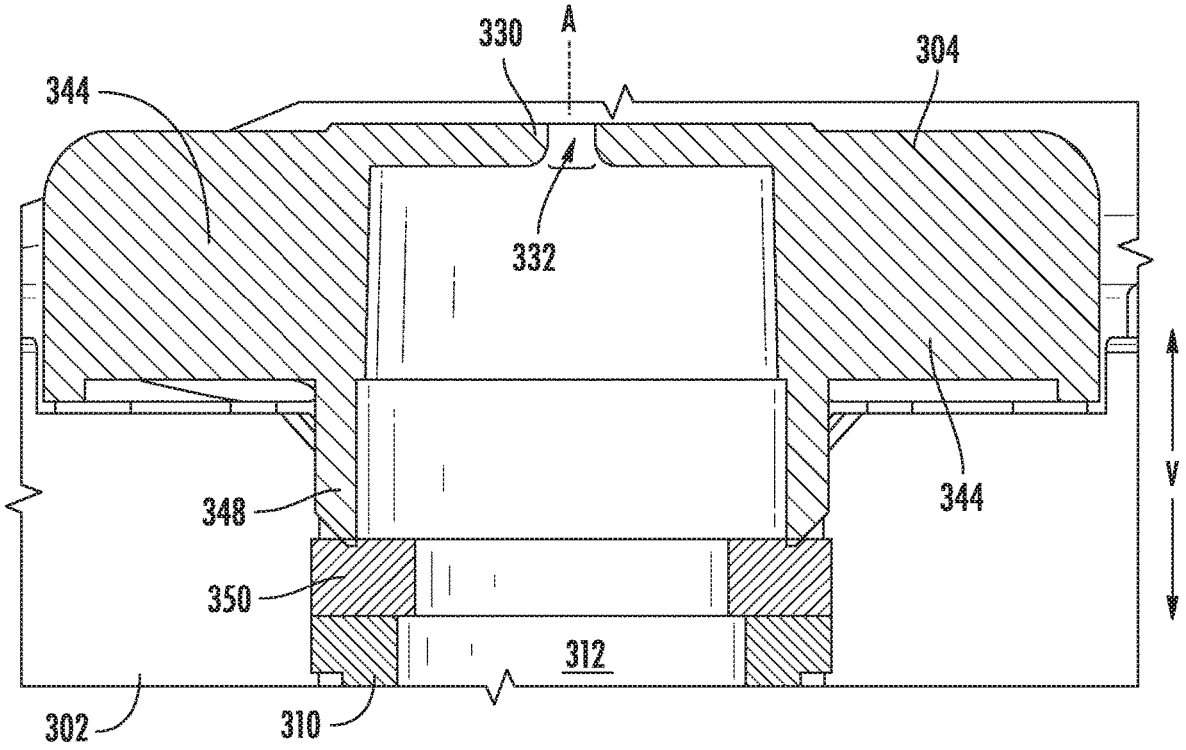
FIG. 13 provides a sectional, elevation view of a portion of the exemplary water dispensing assembly of FIG. 8.

Turning briefly to FIG. 13, in alternative embodiments, a single outlet aperture 332 is defined by spray cap 304. For instance, the single outlet aperture 332 may be defined in the middle of spray cap 304, such as along the vertical spray axis A. Additionally or alternatively, the single outlet aperture 332 may be directed on the vertical spray axis A. Thus, water sprayed therefrom may travel along or parallel to the vertical spray axis A.

Returning generally to FIGS. 8 through 12, spray cap 304 is formed from a suitable food-safe material. For instance, spray cap 304 may be an insulating polymer, such as a silicone material. When assembled, spray cap 304 may be selectively (i.e., removably) supported on dispenser base 302 to move (e.g., rotate) between an unsecured position (FIG. 11) in which spray cap 304 is permitted to move vertically relative to dispenser base 302 and a secured position (FIG. 12) in which vertical movement of spray cap 304 relative to dispenser base 302 is restricted. In particular, spray cap 304 can be selectively secured (e.g., mounted in the secured position) to dispenser base 302 by one or more rotatably-engaged features. For instance, dispenser base 302 may define one or more receiving slots 336 (e.g., within or through cup wall 324) radially spaced apart from water path 312 to selectively receive an attachment wing 334 of spray cap 304. Optionally, each receiving slot 336 may be defined, at least in part, by a radial overhang 338 that extends radially inward from an outer perimeter of a relief defined at the bottom of the cup wall 324 (e.g., within which the spray cap 304 can rotate). In some such embodiments, multiple receiving slots 336 are circumferentially spaced apart from each other about a terminal end of the water path 312.

As shown, attachment wing 334 may extend radially outward from a nozzle head 330. For instance, attachment wing 334 may extend from a portion of nozzle head 330 below the outlet apertures 332. In some such embodiments attachment wing 334 extends perpendicular to the vertical spray axis A. Along with extending radially, each attachment wing 334 extends circumferentially about the vertical spray axis A between a corresponding leading edge 340 and terminal edge 342. Thus, attachment wing 334 may extend less than 360 degrees about the vertical spray axis A. In optional embodiments, one or more thumb stop or vertical flanges 344 extend vertically (e.g., upward) from a corresponding attachment wing 334 at a location between leading edge 340 and terminal edge 342. As spray cap 304 is rotated on dispenser base 302, a vertical flange 344 may engage a portion of cup wall 324 (e.g., at a radial overhang 338) to restrict rotational movement of spray cap 304 between the unsecured and secured positions. For instance, a first vertical flange 344 may be positioned circumferentially rearward (i.e., offset) from leading edge 340. Additionally or alternatively, a second vertical flange 344 may be positioned at the terminal edge 342 (e.g., circumferentially rearward from the first vertical flange 344 on the same attachment wing 334).

Optionally, a tapered top surface 346 may be defined at the leading edge 340 (e.g., such that the vertical width of the attachment wing 334 increases circumferentially toward the terminal edge 342). Thus, rotation of the attachment wing 334 beneath the radial overhang 338 may push the spray cap 304 downward with the increase in vertical height (e.g., thickness) of the attachment wing 334.

Generally, spray cap 304 may include at least as many attachment wings 334 as there are receiving slots 336. Thus, each attachment wing 334 may correspond to a discrete receiving slot 336. Moreover, multiple attachment wings 334 may be circumferentially spaced apart from each other about the vertical spray axis A. In the secured position, a radial overhang 338 may thus circumferentially align with and restrict vertical movement of a corresponding attachment wing 334. In the unsecured position, each attachment wing 334 may be circumferentially offset from each radial overhang 338.

In exemplary embodiments, spray cap 304 further includes a retention collar 348 that extend vertically (e.g., downward) from nozzle head 330. When mounted to dispenser base 302, retention collar 348 may be received within a portion of the water path 312, further sealing and radially securing nozzle head 330 to dispenser base 302. In optional embodiments, a discrete gasket 350 is received within water path 312 (e.g., below retention collar 348) to selectively contact retention collar 348 in the secured position.

Advantageously, the spray cap 304 may be easily removed and cleaned (e.g., when removed) to be sanitized or cleared of sediment, suspended solids, or dissolved solids that might otherwise block an outlet aperture 332.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

a conductive ice mold defining a mold cavity;

a sealed refrigeration system comprising an evaporator in thermal communication with the ice mold; and a water dispenser positioned below the ice mold to direct an ice-building spray of water to the mold cavity, the water dispenser comprising a dispenser base and a spray cap selectively secured to the dispenser base, the spray cap comprising a nozzle head defining an outlet aperture and an attachment wing extending radially from the nozzle head into the dispenser base, wherein the dispenser base defines a water path upstream from the nozzle head, wherein the spray cap further comprises a retention collar extending from the nozzle head, and wherein the water dispenser further comprises a gasket received within the water path in selective contact with the retention collar.

2. The ice making assembly of claim 1, wherein the dispenser base comprises a guide ramp extending at a non-vertical angle from an upper edge to a lower edge, and a cup wall defining a nozzle recess below the guide ramp, wherein the spray cap is received within the nozzle recess.

3. The ice making assembly of claim 2, wherein the ice mold defines a maximum horizontal mold width, and wherein the nozzle recess defines a maximum horizontal recess width, the maximum horizontal mold width being larger than the maximum horizontal recess width.

4. The ice making assembly of claim 1, wherein the spray cap is a silicone material.

5. The ice making assembly of claim 1, wherein the outlet aperture is one aperture of a plurality of outlet apertures circumferentially spaced apart about a vertical spray axis.

6. The ice making assembly of claim 5, wherein the plurality of outlet aperture are angled radially outward from the vertical spray axis.

7. The ice making assembly of claim 1, wherein the attachment wing extends circumferentially from a leading edge to a terminal edge, and wherein the attachment wing defines a tapered top surface at the leading edge.

8. The ice making assembly of claim 1, further comprising a water basin positioned below the ice mold to receive excess water from the ice-building spray.

9. The ice making assembly of claim 1, wherein the water dispenser is positioned directly below the ice mold to direct an ice-building spray of water upward into the mold cavity.

10. An ice making assembly comprising:

a conductive ice mold defining a mold cavity;

a sealed refrigeration system comprising an evaporator in thermal communication with the ice mold; and a water dispenser positioned below the ice mold to direct an ice-building spray of water to the mold cavity, the water dispenser comprising a dispenser base defining a water path and a receiving slot radially spaced apart from the water path, and a spray cap selectively secured to the dispenser base downstream from the water path, the spray cap comprising a nozzle head defining a plurality of outlet apertures directed towards the mold cavity and an attachment wing extending radially from the nozzle into the receiving slot, wherein the attachment wing extends circumferentially from a leading edge to a terminal edge, and wherein the attachment wing defines a tapered top surface at the leading edge.

11. The ice making assembly of claim 10, wherein the dispenser base comprises a guide ramp extending at a non-vertical angle from an upper edge to a lower edge, and a cup wall defining a nozzle recess below the guide ramp, wherein the spray cap is received within the nozzle recess.

12. The ice making assembly of claim 11, wherein the ice mold defines a maximum horizontal mold width, and wherein the nozzle recess defines a maximum horizontal recess width, the maximum horizontal mold width being larger than the maximum horizontal recess width.

13. The ice making assembly of claim 10, wherein the spray cap is a silicone material.

14. The ice making assembly of claim 10, wherein the outlet aperture is one aperture of a plurality of outlet apertures circumferentially spaced apart about a vertical spray axis.

15. The ice making assembly of claim 14, wherein the plurality of outlet aperture are angled radially outward from the vertical spray axis.

16. The ice making assembly of claim 10, wherein the spray cap further comprises a retention collar extending from the nozzle head, and wherein the water dispenser further comprises a gasket received within the water path in selective contact with the retention collar.

17. The ice making assembly of claim 10, further comprising a water basin positioned below the ice mold to receive excess water from the ice-building spray.

18. The ice making assembly of claim 10, wherein the water dispenser is positioned directly below the ice mold to direct an ice-building spray of water upward into the mold cavity.

19. An ice making assembly comprising:

a conductive ice mold defining a mold cavity;

a sealed refrigeration system comprising an evaporator in thermal communication with the ice mold; and a water dispenser positioned below the ice mold to direct an ice-building spray of water to the mold cavity, the water dispenser comprising a dispenser base and a spray cap selectively secured to the dispenser base, the spray cap comprising a nozzle head defining an outlet aperture and an attachment wing extending radially from the nozzle head into the dispenser base, wherein the attachment wing extends circumferentially from a leading edge to a terminal edge, and wherein the attachment wing defines a tapered top surface at the leading edge.

20. The ice making assembly of claim 19, wherein the dispenser base comprises a guide ramp extending at a non-vertical angle from an upper edge to a lower edge, and a cup wall defining a nozzle recess below the guide ramp, wherein the attachment wing is received within the nozzle recess, wherein the water dispenser is positioned directly below the ice mold to direct an ice-building spray of water upward into the mold cavity, wherein the dispenser base defines a water path upstream from the nozzle head, wherein the spray cap further comprises a retention collar extending from the nozzle head, and wherein the water dispenser further comprises a gasket received within the water path in selective contact with the retention collar.

* * * * *